US009109558B2

(12) United States Patent
Suzuki

(10) Patent No.: US 9,109,558 B2
(45) Date of Patent: Aug. 18, 2015

(54) FUEL PUMP

(75) Inventor: Masashi Suzuki, Obu (JP)

(73) Assignee: DENSO CORPORATION, Kariya (JP)

( * ) Notice: Subject to any disclaimer, the term of this patent is extended or adjusted under 35 U.S.C. 154(b) by 388 days.

(21) Appl. No.: 13/353,555

(22) Filed: Jan. 19, 2012

(65) Prior Publication Data

US 2012/0186559 A1 Jul. 26, 2012

(30) Foreign Application Priority Data

Jan. 24, 2011 (JP) ..... 2011-11912

(51) Int. Cl.

| | |
|---|---|
| ***F02M 37/04*** | (2006.01) |
| ***F02M 59/06*** | (2006.01) |
| ***F02M 59/10*** | (2006.01) |
| ***F02M 59/38*** | (2006.01) |
| ***F02M 59/44*** | (2006.01) |

(52) U.S. Cl.

CPC ..... *F02M 59/06* (2013.01); *F02M 59/102* (2013.01); *F02M 59/38* (2013.01); *F02M 59/44* (2013.01); *F02M 2200/18* (2013.01)

(58) Field of Classification Search

CPC ..... F02M 59/04; F02M 59/06; F02M 59/38; F02M 59/44; F02M 59/102; F02M 2200/18; F04B 1/02; F04B 1/0413; F04B 1/0426; F02D 59/08

USPC ..... 123/495, 496, 508, 198 D; 417/269, 417/273, 437; 92/61, 72, 129

See application file for complete search history.

(56) References Cited

U.S. PATENT DOCUMENTS

| | | | | |
|---|---|---|---|---|
| 6,244,832 | B1 * | 6/2001 | Guentert et al. | 417/269 |
| 6,289,875 | B1 * | 9/2001 | Shinohara et al. | 123/450 |
| 2003/0106427 | A1 * | 6/2003 | Nagai et al. | 92/129 |
| 2004/0089146 | A1 * | 5/2004 | Diaferia et al. | 91/491 |
| 2005/0076888 | A1 | 4/2005 | Hanyu | |
| 2006/0275164 | A1 * | 12/2006 | Ganser | 417/521 |
| 2006/0280620 | A1 * | 12/2006 | Kleinbeck et al. | 417/273 |
| 2008/0178845 | A1 | 7/2008 | Shimai | |

(Continued)

FOREIGN PATENT DOCUMENTS

| | | |
|---|---|---|
| CN | 1605748 | 4/2005 |
| CN | 101235778 | 8/2008 |
| DE | 10229395 A1 * | 1/2004 |

(Continued)

OTHER PUBLICATIONS

Office Action (5 pgs.) issued Dec. 3, 2013 in corresponding Chinese Application No. 2012100227162 with an at least partial English-language translation thereof (6 pgs.).

(Continued)

*Primary Examiner* — Mahmoud Gimie
*Assistant Examiner* — John Zaleskas
(74) *Attorney, Agent, or Firm* — Nixon & Vanderhye P.C.

(57) ABSTRACT

First and second recessed portions are respectively formed on first and second wall surfaces of a cam chamber, in order that a plunger head and a coil spring would not come in touch with the first and second wall surfaces even in such a virtual situation. In the virtual situation, it is supposed that the plunger head would be separated from a plunger, the plunger head remains in contact with a contact surface of a cam ring so that the plunger head would not move relative to the contact surface, and a cam member would be continuously rotated.

4 Claims, 6 Drawing Sheets

(56) References Cited

U.S. PATENT DOCUMENTS

| | | | | |
|---|---|---|---|---|
| 2009/0120280 | A1 * | 5/2009 | Takamizawa et al. | 92/72 |
| 2010/0269795 | A1 * | 10/2010 | Boecking | 123/495 |

FOREIGN PATENT DOCUMENTS

| | | | | |
|---|---|---|---|---|
| DE | 102007055263 | A1 | * | 5/2009 |
| DE | 102008001585 | A1 | * | 11/2009 |
| DE | 102009000965 | A1 | * | 8/2010 |
| FR | 2814502 | A1 | * | 3/2002 |
| JP | 2000-054935 | | | 2/2000 |
| JP | 2000054935 | A | * | 2/2000 |
| JP | 2003-232270 | | | 8/2003 |
| JP | 2004-360554 | | | 12/2004 |
| JP | 2010-209802 | | | 9/2010 |
| WO | WO 2009127485 | A1 | * | 10/2009 |
| WO | WO 2011029649 | A1 | * | 3/2011 |

OTHER PUBLICATIONS

Office Action (2 pages) dated Feb. 18, 2014, issued in corresponding Japanese Application No. 2011-011912 and English translation (3 pages).

* cited by examiner

FUEL PUMP

CROSS REFERENCE TO RELATED APPLICATION

This application is based on Japanese Patent Application No. 2011-11912 filed on Jan. 24, 2011, the disclosure of which is incorporated herein by reference.

FIELD OF THE INVENTION

The present invention relates to a fuel pump for pressurizing fuel and supplying such pressurized fuel, in particular to a fuel pump for supplying the pressurized fuel to an internal combustion engine via a common rail.

BACKGROUND OF THE INVENTION

A fuel pump, which supplies high pressure fuel to an internal combustion engine via a common rail, is known in the art, for example, as disclosed in Japanese Patent Publication No. 2000-240531. Such a conventional fuel pump is shown in FIG. 6 attached to the present application. The fuel pump 100 has high pressure pump portions 101 for pressurizing fuel and pumping out such pressurized fuel, a cam mechanism 102 driven by the internal combustion engine to operate the high pressure pump portions 101, and a pump housing 103 for accommodating the cam mechanism 102 and holding the high pressure pump portions 101.

Each of the high pressure pump portions 101 is composed of a fuel pressurizing chamber 104 and a plunger 105 movably arranged in a cylindrical bore to expand or reduce the fuel pressurizing chamber 104, so that the fuel is sucked into the fuel pressurizing chamber 104 and pressurized fuel is pumped out from the fuel pressurizing chamber 104.

The cam mechanism 102 is composed of a shaft 106 driven to rotate by the engine, a cam member 107 integrally formed with the shaft 106 and a cam ring 108. The cam member 107 is eccentric with the shaft 106 and driven to rotate by the rotation of the shaft 106. An inner peripheral surface of the cam ring 108 is movably supported by an outer peripheral surface of the cam member 107, so that the cam ring 108 moves around the shaft 106 in accordance with the rotation of the cam member 107, without changing its posture.

A plunger head 109 having a larger diameter than that of the plunger 105 is integrally formed with the plunger 105 at its one axial end, which is on an opposite side of the fuel pressurizing chamber 104. The cam ring 108 has a contact surface 110, which is in contact with the plunger head 109. A coil spring 111 is provided for biasing the plunger head 109 toward the contact surface 110, so that the plunger head 109 is brought into contact with the contact surface 110. The plunger head 109 slides on the contact surface 110 so as to move relative to the cam ring 108, while the plunger head 109 is reciprocated in an axial direction of the plunger 105, in accordance with the rotation of the cam ring 108. A cam chamber 112 is formed in the housing 103 for accommodating the cam member 107, the cam ring 108, and the plunger head 109.

According to the above structure, since the fuel pressurizing chamber 104 is expanded and/or reduced in accordance with the reciprocal movement of the plunger 105, which is integrally formed with the plunger head 109, each of the high-pressure pump portions 101 draws the fuel into the fuel pressurizing chamber 104 and pressurizes the fuel to pump out the pressurized fuel from the fuel pressurizing chamber 104.

In recent years, various kinds of countermeasures have been taken into consideration so as to improve reliability of the fuel pump 100, supposing that inferior fuel including extraneous matters would be used, an abnormal high pressure would be generated and so on.

A countermeasure in view of a structure of the fuel pump is taken into consideration as one of countermeasures for improving the reliability, when supposing such a case in which the plunger head 109 would be separated from the plunger 105 as a result of use of the inferior fuel or generation of the abnormal high pressure.

In the case that the plunger head 109 was separated from the plunger 105, the relative movement of the plunger head 109 to the contact surface 110 ceases, and thereby the plunger head 109 would move together with the cam ring 108 and would be displaced in a direction other than the axial direction of the plunger 105. Then, an adverse and unexpected influence may be generated by the plunger head 109 against the pump housing 103.

It is, therefore, known in the art to provide a guide member for movably supporting the plunger head 109 in the axial direction of the plunger, in order to avoid a situation that the movement of the plunger head 109 relative to the contact surface 110 may be stopped. Namely, according to the above structure that the plunger head 109 is supported by the guide member, the plunger head can still relatively reciprocate on the contact surface 110, even when the plunger head 109 was separated from the plunger 105.

However, according to such a structure, a number of parts and components is inevitably increased. It is, therefore, desired to improve the reliability of the fuel pump without increasing the number of parts and components, supposing that the plunger head 109 would be separated from the plunger 105.

SUMMARY OF THE INVENTION

The present invention is made in view of the above problems. It is an object of the present invention to provide a fuel pump, according to which the reliability is improved without increasing a number of parts and components, wherein such a virtual situation that a plunger head would be separated from a plunger is taken into consideration.

According to a feature of the present invention (for example, as defined in the appended claim 1), a fuel pump has a high pressure pump portion for pressurizing fuel and pumping out such pressurized fuel, a cam mechanism driven by an internal combustion engine for operating the high pressure pump portion, and a pump housing for accommodating the cam mechanism and supporting the high pressure pump portion. The high pressure pump portion has a pressurizing chamber and a plunger for expanding and/or reducing the pressurizing chamber, so that fuel is sucked into the pressurizing chamber and pumped out from the pressurizing chamber in accordance with the expansion and reduction of the pressurizing chamber.

The cam mechanism has a shaft driven to rotate by the engine, a cam member integrally and eccentrically formed with the shaft so that the cam member moves around the shaft in accordance with the rotation of the shaft, and a cam ring movably supported by the cam member so as to move around the shaft without changing its posture.

A plunger head is integrally formed with the plunger at one axial end thereof, which is an opposite side of the pressurizing chamber, wherein the plunger head has a larger diameter than the plunger. The cam ring has a contact surface, which is in a sliding contact with the plunger head. The plunger head is biased by a biasing member in a direction to the one axial end of the plunger so that the plunger head is in contact with the contact surface, wherein the plunger head moves on the contact surface to reciprocate relative to the contact surface and reciprocates in an axial direction of the plunger in accordance with the rotation of the cam ring.

The pump housing has a cam chamber for accommodating the cam member, the cam ring and the plunger head.

Such a virtual situation is supposed, wherein the plunger head would be separated from the plunger, the plunger head would be in contact with the contact surface without a relative movement of the plunger head to the contact surface, and the cam member would be continuously rotated. The cam chamber is so formed that the plunger head would not come in touch with a wall surface of the cam chamber even in the virtual situation.

According to the above structure, even when the plunger head was separated from the plunger and moved together with the cam ring in the direction other than the axial direction of the plunger, the plunger head would not come in touch with the wall surface of the cam chamber. Since the unexpected adverse influence to the pump housing by the plunger head can be avoided, the reliability of the fuel pump can be improved, for which the virtual situation that the plunger head would be separated from the plunger is taken into consideration.

The cam chamber can be thus formed so that the plunger head would not come in touch with the wall surface of the cam chamber in the virtual situation, without increasing the number of parts and components.

According to another feature of the present invention (for example, as defined in the claim 2), the biasing member is composed of a coil spring, which is coaxially arranged with the plunger and one axial end of which is supported by the plunger head. The cam chamber is so formed that the coil spring would not come in touch with the wall surface of the cam chamber even in the virtual situation, wherein it is further supposed that the one axial end of the coil spring would be continuously supported by the plunger head.

In the virtual situation, it is supposed that the one axial end of the coil spring would move together with the plunger head in the direction other than the axial direction of the plunger, so long as the plunger head would continuously function as the supporting portion for the one axial end of the coil spring even in the virtual situation.

When the cam chamber is so formed that not only the plunger head but also the coil spring would not come in touch with the wall surface of the cam chamber in the virtual situation, the reliability of the fuel pump can be further improved.

According to a further feature of the present invention (for example, as defined in the claim 3), the cam chamber is so formed that the coil spring would not come in touch with the wall surface of the cam chamber in the virtual situation. The cam chamber may be optionally further formed that the plunger head would not come in touch with the wall surface of the cam chamber in the virtual situation.

According to such a feature, although the plunger head could come in touch with the wall surface of the cam chamber in the virtual situation, the possible adverse influence by the plunger head to the wall surface of the cam chamber could be reduced. Therefore, the reliability of the fuel pump can be likewise improved, for which the virtual situation that the plunger head would be separated from the plunger is taken into consideration.

BRIEF DESCRIPTION OF THE DRAWINGS

The above and other objects, features and advantages of the present invention will become more apparent from the following detailed description made with reference to the accompanying drawings. In the drawings.

Figure 1:
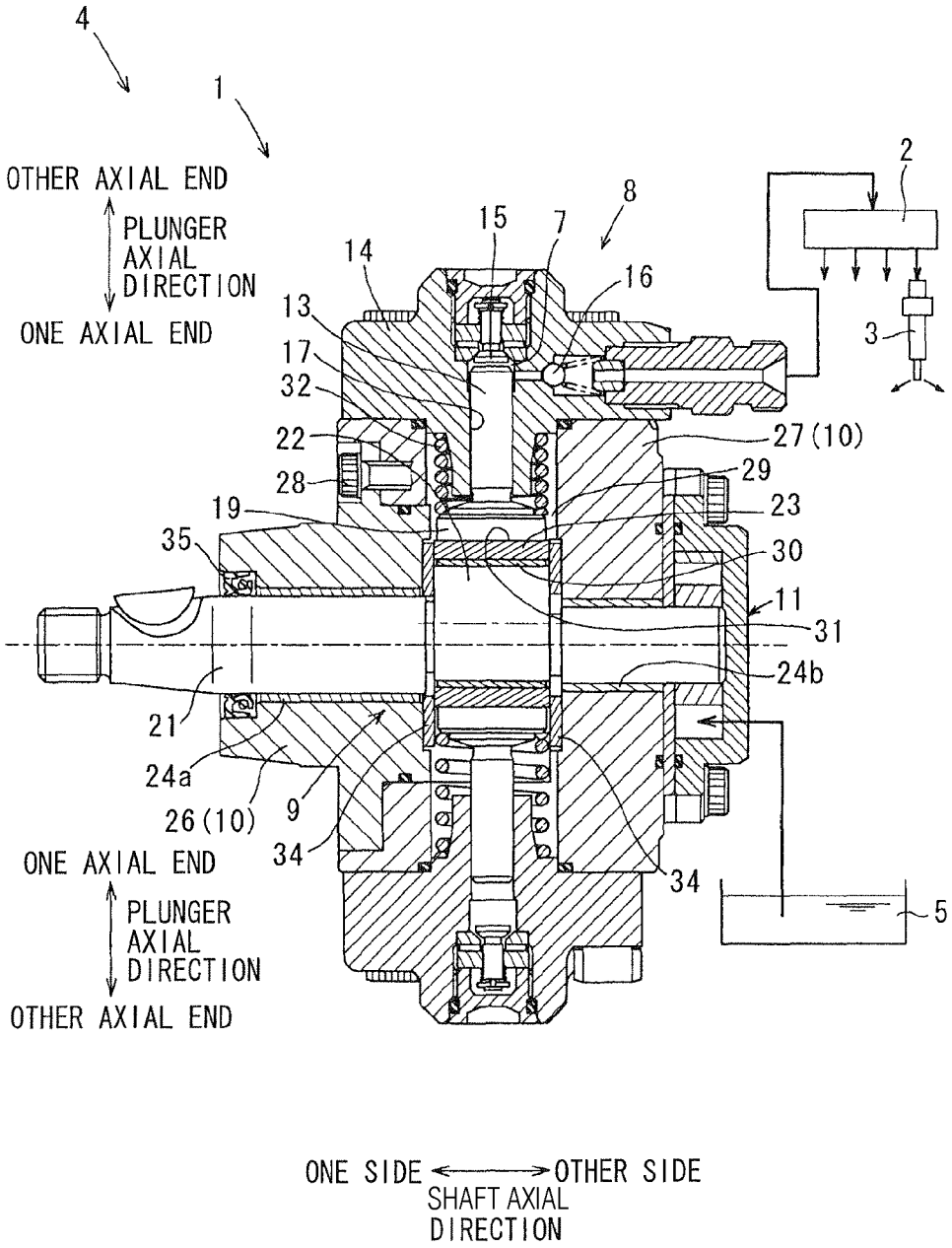
FIG. 1 is a schematic diagram showing a structure of a fuel injection apparatus and showing a cross sectional view of a fuel pump taken along a longitudinal plane including a shaft, according to an embodiment of the present invention.

DETAILED DESCRIPTION OF THE PREFERRED EMBODIMENTS (Embodiment)

A structure of a fuel pump 1 according to an embodiment of the present invention will be explained with reference to FIGS. 1 and 2.

The fuel pump 1 pressurizes and pumps out fuel, which will be injected into an internal combustion engine (not shown) of a vehicle. The fuel pump 1 forms a part of a common-rail type fuel injection apparatus 4, according to which high pressure fuel accumulated in a common rail 2 is injected into the engine by a fuel injection valve 3. The fuel pump 1 draws the fuel from a fuel tank 5 to pressurize and pump out the fuel to the common rail 2. The fuel injection apparatus 4 has an electronic control unit (ECU) for controlling operations of various kinds of actuators and/or devices.

The fuel pump 1 has multiple high pressure pump portions 8, each of which forms a pressurizing chamber 7 to pressurize fuel and to pump out such pressurized fuel; a cam mechanism 9 driven by the internal combustion engine to operate the high pressure pump portions 8; and a pump housing 10 for accommodating the cam mechanism 9 and for holding the high pressure pump portions 8. In addition, the fuel pump 1 has a low pressure feed pump portion 11 for drawing the fuel from the fuel tank 5 and a fuel-feed amount controlling valve (not shown) for controlling an amount of the fuel to be supplied from the low pressure feed pump portion 11 to the high pressure pump portions 8. The fuel-feed amount controlling valve is electronically controlled by the ECU depending on a demand value for the fuel, so that the amount of the fuel drawn by the feed pump portion 11 is controlled by the fuel-feed amount controlling valve and such fuel is supplied to the respective pressurizing chambers 7 of the high pressure pump portions 8.

Each of the high pressure pump portions 8 has a plunger 13 driven by the cam mechanism 9 so as to reciprocate in its axial direction; a cylinder head 14 for movably supporting the plunger 13; an intake valve 15 for allowing or stopping fuel flow into the pressurizing chamber 7; and a discharge valve 16 for allowing or stopping fuel flow out of the pressurizing chamber 7. The plunger 13 is movably accommodated in a cylinder bore 17 formed in the cylinder head 14, to thereby form the pressurizing chamber 7.

One axial end of the plunger 13 is protruding from the cylinder bore 17 and a plunger head 19, which has a larger diameter than the plunger 13, is integrally formed at such a protruding end of the plunger 13. The other axial end of the plunger 13 forms one part (one end) of the pressurizing chamber 7 and reciprocates in the axial direction thereof so as to expand or reduce the pressurizing chamber 7 in accordance with its reciprocal movement. The other end of the pressurizing chamber 7 is defined by the intake valve 15.

An inner diameter of the cylinder bore 17 at its axial end on a side closer to the intake valve 15 is made larger than that of the other portion of the cylinder bore 17, so that the plunger 13 does not directly slide on an inner peripheral surface of the cylinder bore 17 at such a large-diameter portion. A fuel discharge passage formed in the cylinder head 14 is connected to the large-diameter portion. The discharge valve 16 is provided in the fuel discharge passage so as to open or close the fuel discharge passage to the common rail 2.

Figure 2:
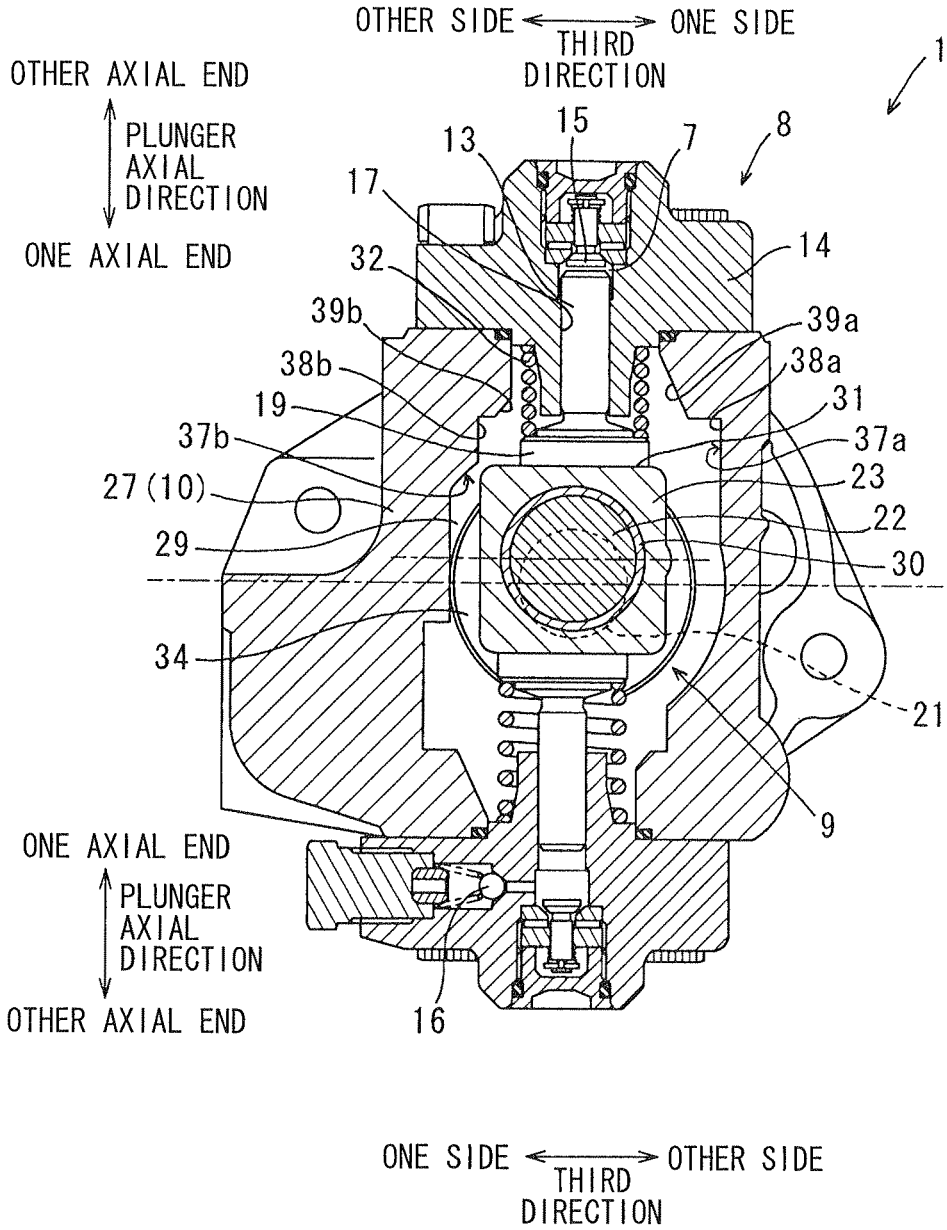
FIG. 2 is a schematic cross sectional view, taken along a plane perpendicular to the shaft, showing the fuel pump.

As shown in FIG. 1 or 2, the fuel pump 1 has two high pressure pump portions 8, which are arranged on opposite sides to each other and displaced by 180 degrees around the cam mechanism 9. An axial end of each plunger 13, at which the plunger head 19 is formed, is referred to as "one axial end", while an axial end of the plunger 13, at which the pressurizing chamber 7 is formed, is also referred to "the other axial end".

The cam mechanism 9 is composed of a shaft 21 driven to rotate by the engine, a cam member 22 integrally formed with the shaft 21 and a cam ring 23. The cam member 22 is eccentric with the shaft 21 and driven to rotate around the shaft 21 by the rotation of the shaft 21. An inner peripheral surface of the cam ring 23 is movably supported by an outer peripheral surface of the cam member 22, so that the cam ring 23 moves around the shaft 21 in accordance with the rotation of the cam member 22, without changing its posture.

The shaft 21 is rotatably supported by the pump housing 10 via journal bearings 24*a* and 24*b*. The pump housing 10 is composed of a bearing cover 26 provided at one axial side of the shaft 21 for supporting the shaft 21 and a housing body 27 provided at the other axial side of the shaft 21 for supporting the shaft 21. The journal bearings 24*a* and 24*b* are respectively accommodated in the bearing cover 26 and the housing body 27 for rotatably supporting the shaft 21. The bearing cover 26 is fixed to the housing body 27 by bolts 28.

A gear member (not shown) is engaged with one end of the shaft 21, so that a rotational torque is transmitted from the engine to the shaft 21 via the gear member.

The low pressure feed pump portion 11 is provided at the other axial side of the shaft 21 and is directly driven to rotate by the shaft 21.

The cam member 22 is provided in the shaft 21 between a shaft portion (on a left-hand side in the drawing) rotatably supported by the bearing cover 26 via the journal bearing 24*a* and another shaft portion (on a right-hand side in the drawing) rotatably supported by the housing body 27 via the journal bearing 24*b*. The cam member 22 is accommodated in a cam chamber 29 together with the plunger head 19, the cam ring 23 and so on.

The cam chamber 29 is formed by the cylinder head 14, the bearing cover 26, the housing body 27 and so on. The cylinder head 14 is made of iron, while the bearing cover 26 and the housing body 27 are made of aluminum.

The cam ring 23 is movably supported by the cam member 22 via a bushing 30. The plunger head 19 slides on the cam ring 23 when the cam member 22 is rotated.

The cam ring 23 has a contact surface 31, which is perpendicular to the axial direction of the plunger 13 and with which the plunder head 19 is in contact. While the plunger head 19 slides on the contact surface 31 in accordance with the rotation of the cam member 22 and the cam ring 23, the plunger head 19 reciprocates in the axial direction of the plunger 13. Namely, in addition to the reciprocal movement in the axial direction of the plunger 13, the plunger head 19 moves relative to the cam ring 23 in a direction (hereinafter referred to as a third direction), which is perpendicular to both of the axial direction of the plunger 13 and an axial direction of the shaft 21. The third direction corresponds to a horizontal direction in FIG. 2. The third direction is in parallel to the contact surface 31 and is defined by the respective high pressure pump portions 8 (in other words, differs from the pump portion to the pump portion).

A coil spring 32, which is compressed in the axial direction of the plunger 13, is arranged between the cylinder head 14 and the plunger head 19, so that the plunger head 19 is biased by the coil spring 32 in the direction toward the one axial end of the plunger 13 (that is, toward the cam ring 23) and thereby the plunger head 19 is brought into contact with the contact surface 31. Since the cam ring 23 is rotated without changing its posture, the contact surface 31 is rotated in the same manner. Therefore, the plunger head 19 slides on the contact surface 31 so as to reciprocate in the axial direction of the plunger 13 and to move (reciprocate) relative to the contact surface 31 in the third direction.

Thrust washers 34 are arranged at both sides of the cam member 22 and the cam ring 23 in the direction of the shaft 21.

A part of the fuel from the low pressure feed pump portion 11 is supplied into the cam chamber 29 without passing through the fuel-feed amount controlling valve (not shown), the pressurizing chamber 7 or the like. The fuel in the cam chamber 29 is used as lubricating oil for such bearing portions, sliding portions and so on. An oil seal 35 is provided at the axial end of the bearing cover 26 between the shaft 21 and the bearing cover 26 for sealing the fuel as the lubricating oil.

According to the fuel pump 1 of the above explained structure, the plunger 13 moves in the axial direction (in the direction to the one axial end of the plunger 13, that is, in the direction to the cam ring 23) in accordance with the rotation of the cam member 22, so that the pressurizing chamber 7 is expanded. Then, the fuel pressure in the pressurizing chamber 7 is decreased to close the discharge valve 16 and to open the intake valve 15, so that the fuel is sucked into the pressurizing chamber 7 (the amount of which is already adjusted by the fuel-feed amount controlling valve). On the other hand, when the plunger is moved in the opposite direction (in the direction to the other axial end of the plunger 13, that is, in the direction to the intake valve 15), the pressurizing chamber 7 is reduced, to thereby increase the fuel pressure in the pressurizing chamber 7. Then, the intake valve 15 is closed and the discharge valve 16 is opened, so that the pressurized fuel is pumped out from the pressurizing chamber 7 and discharged to the common rail 2.

Characterizing features of the fuel pump 1 of the present embodiment will be explained with reference to FIGS. 2 to 4.

At first, the following virtual situation is supposed for the purpose of explaining the characterizing features of the fuel pump 1. In such a virtual situation, the plunger head 19 would be separated from the plunger 13, the plunger head 19 would remain in contact with the contact surface 31 without any sliding movement relative to the contact surface 31, and the cam member 22 would be continuously rotated (as shown in FIG. 33 and FIG. 4B). In the above virtual situation, it is supposed that the one axial end of the coil spring 32 would be still supported by the plunger head 19.

In case of the upper side pump portion 8 (in FIG. 2), a right-hand side of the contact surface 31 of the cam ring 23 in the drawing is defined as "one side (or a first side) of the third direction", wherein the plunger head 19 is displaced from a center of the contact surface 31 toward the right-hand direction when the plunger 13 is at its top dead center (a volume of the pressurizing chamber 7 is minimized). A left-hand side of the contact surface 31 is then defined as "the other side (or a second side) of the third direction".

In a similar manner, in case of the lower side pump portion 8 (in FIG. 2), a left-hand side of the contact surface (31) in the drawing is defined as "one side (or a first side) of the third direction", wherein the plunger head (19) is displaced from a center of the contact surface (31) toward the left-hand direction when the plunger (13) is at its bottom dead center (a volume of the pressurizing chamber (7) is maximized). A right-hand side of the contact surface (31) is then defined as "the other side (or a second side) of the third direction".

A first wall surface, which is formed in the pump housing on the one side (the first side) of the third direction for forming the cam chamber 29, is designated by a reference numeral 37*a*, while a second wall surface formed in the pump housing on the other side (the second side) of the third direction is designated by a reference numeral 37*b*. The first and second wall surfaces 37*a* and 37*b* are formed in the housing body 27.

According to the fuel pump 1, the plunger head 19 and the coil spring 32 are arranged in the cam chamber 29 in such a way that the plunger head 19 and the coil spring 32 would not come in touch with the first and second wall surfaces 37*a* and 37*b* even in the virtual situation.

In the case that the plunger head 19 was separated from the plunger 13 and the movement of the plunger head 19 relative to the contact surface 31 was stopped, the plunger head 19 would move together with the cam ring 23 in the third direction. Then, the plunger head 19 could come in touch with the first and/or the second wall surfaces 37*a* and 37*b* of the cam chamber 29. If such a touch would occur, such touch would cause unexpected adverse influence to the pump housing 10.

According to the present embodiment, therefore, first recessed portions 38*a* and 38*b* as well as second recessed portions 39*a* and 39*b* are respectively formed on the first and second wall surfaces 37*a* and 37*b*, in order that the plunger head 19 would not cause the adverse influence to the pump housing 10 even when the movement of the plunger head 19 relative to the contact surface 31 was stopped. The first recessed portions 38*a* and 38*b* are formed in order to avoid such a touch between the plunger head 19 and the first and second wall surfaces 37*a* and 37*b*, while the second recessed portions 39*a* and 39*b* are formed in order to avoid a possible touch between the coil spring 32 and the first and second wall surfaces 37*a* and 37*b*.

Figure 3A:
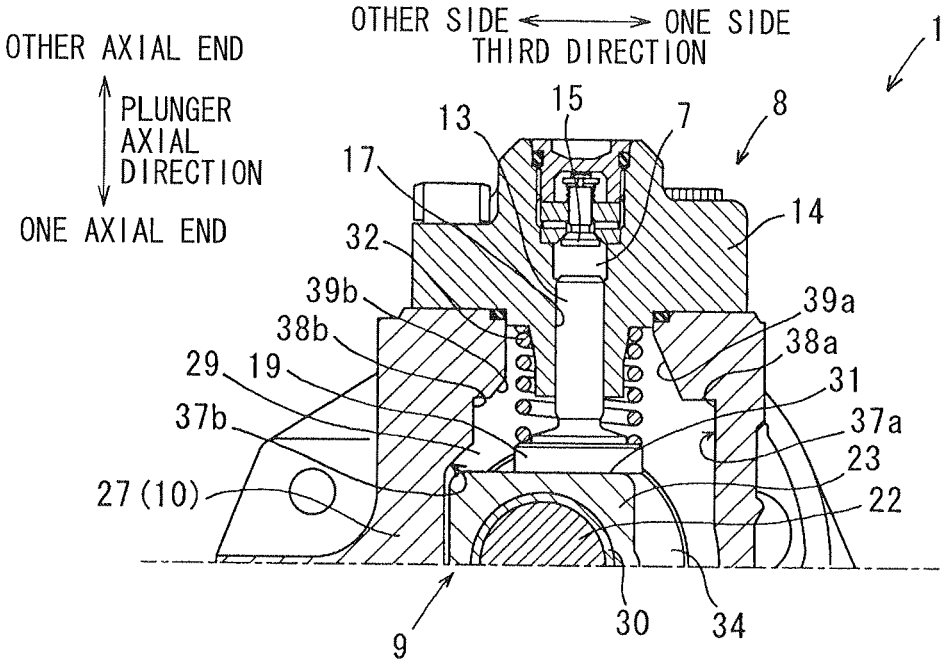
FIG. 3A is a schematic cross sectional view showing a part of the fuel pump in a phase, in which a first virtual situation would occur.
Figure 3B:
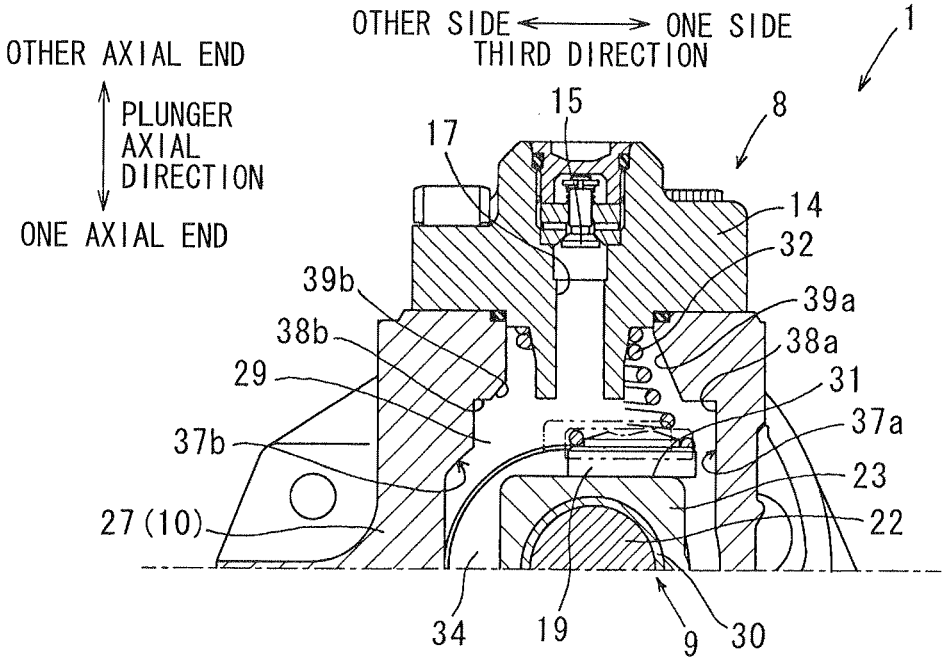
FIG. 3B is a schematic cross sectional view showing the part of the fuel pump, for explaining an excursion of a plunger head in the first virtual situation.

A virtual situation, in which the adverse influence by the possible touch between the plunger head 19 and/or the coil spring 32 and the first wall surface 37*a* would become the largest, corresponds to such a situation (as shown in FIGS. 3A and 3B), in which the plunger head 19 moved on the contact surface 31 to its most remote position from the center of the contact surface 31 toward the one side (first side) of the third direction and the movement of the plunger head 19 relative to the contact surface 31 was stopped and in which the plunger head 19 was continuously rotated with the cam ring 23. The above virtual situation is also referred to as a first virtual situation.

The above first virtual situation would occur when the plunger 13 is in its intermediate position between the top dead center and the bottom dead center, when the cam member 22 and the cam ring 23 are located at a most leftward position (at a most remote position toward the other side (the second side) of the third direction), as shown in FIG. 3A, and when the plunger head 19 was separated from the plunger 13. As shown in FIG. 3B, the first and second recessed portions 38*a* and 39*a* are so formed that the plunger head 19 and the coil spring 32 would not come in touch with the first wall surface 37*a* even in such first virtual situation.

Figure 4A:
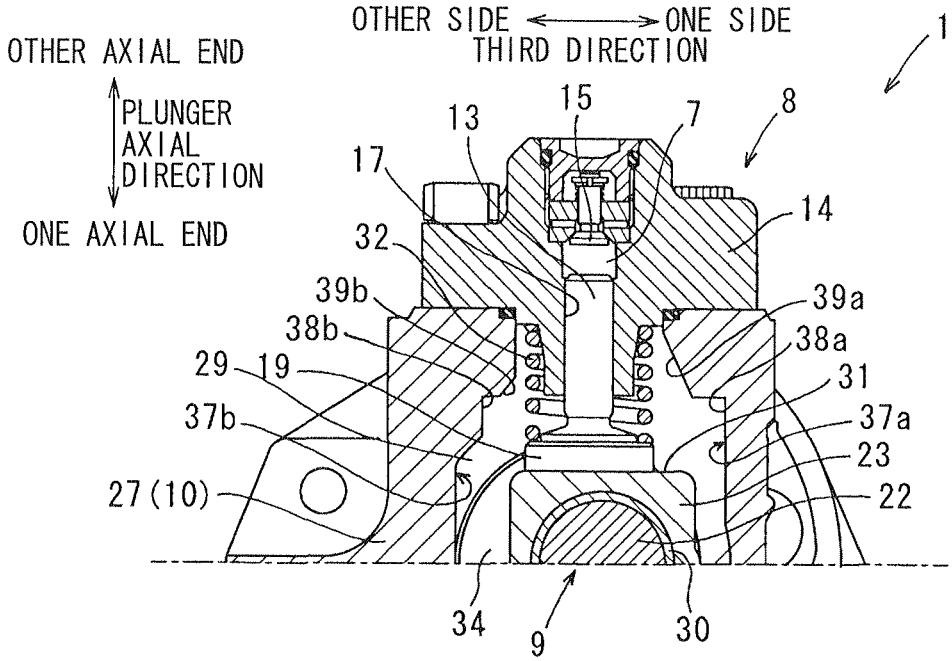
FIG. 4A is a schematic cross sectional view showing a part of the fuel pump in a phase, in which a second virtual situation would occur.
Figure 4B:
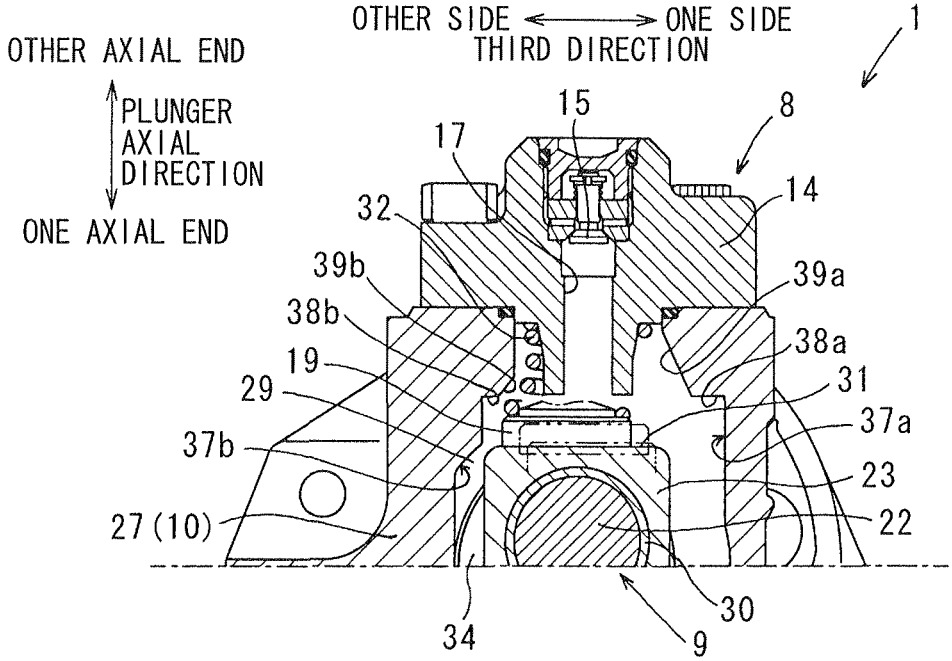
FIG. 4B is a schematic cross sectional view showing the part of the fuel pump, for explaining an excursion of a plunger head in the second virtual situation.

A virtual situation, in which the adverse influence by the possible touch between the plunger head 19 and/or the coil spring 32 and the second wall surface 37*b* would become the largest, corresponds to such a situation (as shown in FIGS. 4A and 4B), in which the plunger head 19 moved on the contact surface 31 to its most remote position from the center of the contact surface 31 toward the other side (second side) of the third direction and the movement of the plunger head 19 relative to the contact surface 31 was stopped and in which the plunger head 19 was continuously rotated with the cam ring 23. The above virtual situation is also referred to as a second virtual situation.

The above second virtual situation would occur when the plunger 13 is in its intermediate position between the top dead center and the bottom dead center, when the cam member 22 and the cam ring 23 are located at a most rightward position (at a most remote position toward the one side (the first side) of the third direction), as shown in FIG. 4A, and when the plunger head 19 was separated from the plunger 13. As shown in FIG. 4B, the first and second recessed portions 38*a* and 39*a* are so formed that the plunger head 19 and the coil spring 32 would not come in touch with the second wall surface 37*b* even in such second virtual situation.

In the above first and second virtual situations, the displacement (deflection) of the plunger head 19 from the center of the contact surface 31 toward the one side (the first side) of the third direction in the first virtual situation is larger than the displacement (deflection) of the plunger head 19 from the center of the contact surface 31 toward the other side (the second side) of the third direction in the second virtual situation.

Accordingly, the first and second recessed portions 38*a* and 39*a* on the first wall surface 37*a* are made to be larger than the first and second recessed portions 38*b* and 39*b* of the second wall surface 37*b*.

(Advantages of the Embodiment)

According to the fuel pump 1 of the above embodiment, the first recessed portions 38*a* and 38*b* are formed on the first and second wall surfaces 37*a* and 37*b* so that the plunger head 19 would not come in touch with the first and second wall surfaces 37*a* and 37*b*, even when the virtual situation is supposed. In the virtual situation, the plunger head 19 is separated from the plunger 13, the relative movement of the plunger head 19 to the contact surface 31 is stopped, and the cam member 22 is continuously rotated.

According to the above structure, the plunger head 19 would not come in touch with the first and second wall surfaces 37*a* and 37*b*, even when the plunger head 19 was separated from the plunger 13 and moved together with the cam ring 23 to reciprocate in the third direction. As a result, the unexpected adverse influence, in which the plunger head 19 would adversely affect the pump housing 10, can be avoided. Therefore, the reliability of the fuel pump 1, for which even the virtual situation (in which the plunger head 19 would be separated from the plunger 13) is supposed, can be improved.

The first recessed portions 38*a* and 38*b* can be formed without increasing the number of parts and components, in order that the plunger head 19 would not come in touch with the first and second wall surfaces 37*a* and 37*b* in the virtual situation.

The second recessed portions 39*a* and 39*b* are formed on the first and second wall surfaces 37*a* and 37*b* so that the coil spring 32 would not come in touch with the first and second wall surfaces 37*a* and 37*b*, even in the virtual situation.

When the plunger head 19 would be still functioning as the supporting portion for the one axial end of the coil spring 32 in the virtual situation, it is supposed that the one axial end of the coil spring 32 would move together with the plunger head 19 in the third direction.

Therefore, when the cam chamber 29 is so formed that not only the plunger head 19 but also the coil spring would not come in touch with the first and second wall surfaces 37*a* and 37*b* even in the virtual situation, the reliability of the fuel pump 1 can be further improved.

(Modifications)

The present invention should not be limited to the above embodiment but can be modified in various manners.

Figure 5:
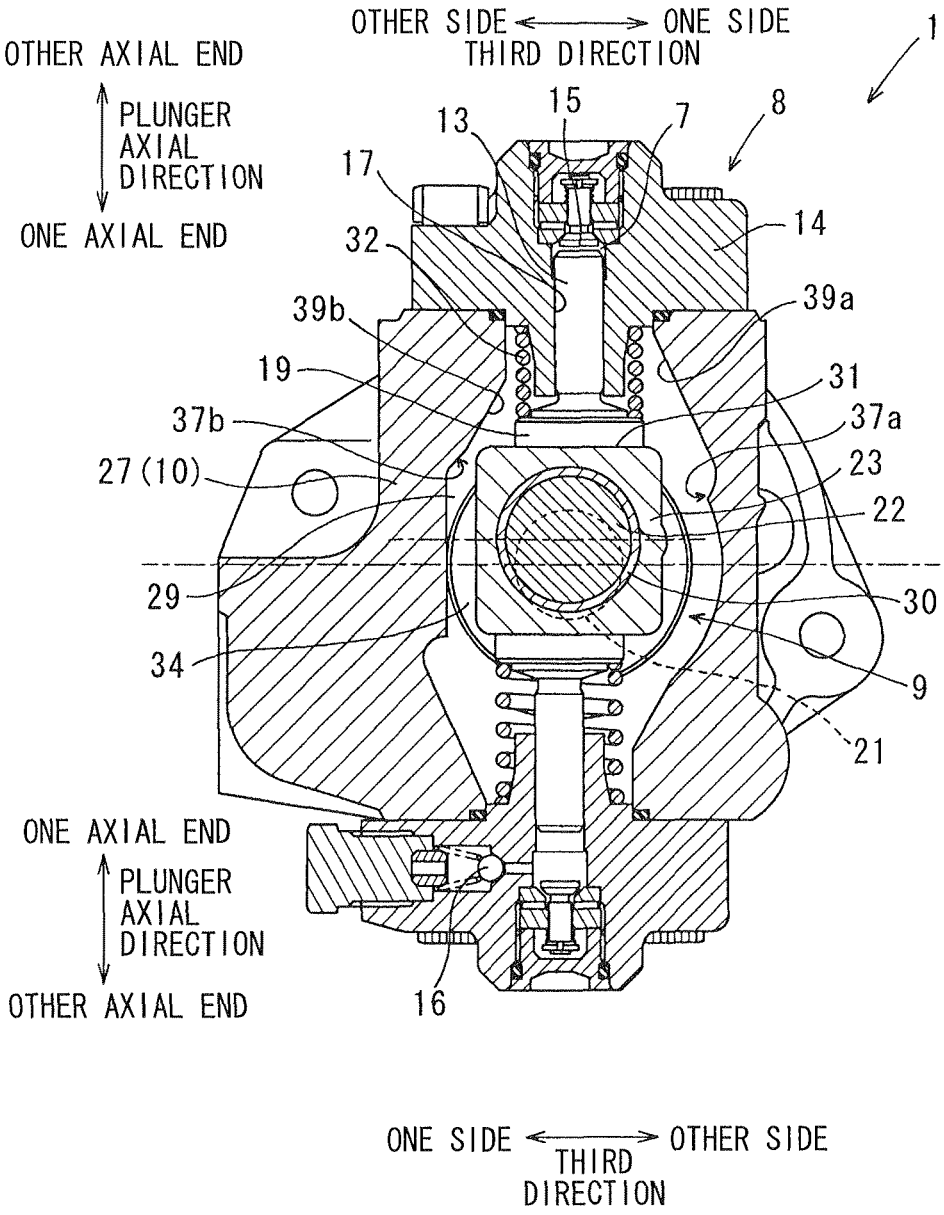
FIG. 5 is a schematic cross sectional view, taken along a plane perpendicular to the shaft, showing a fuel pump according to a modification of the present invention.
Figure 6:
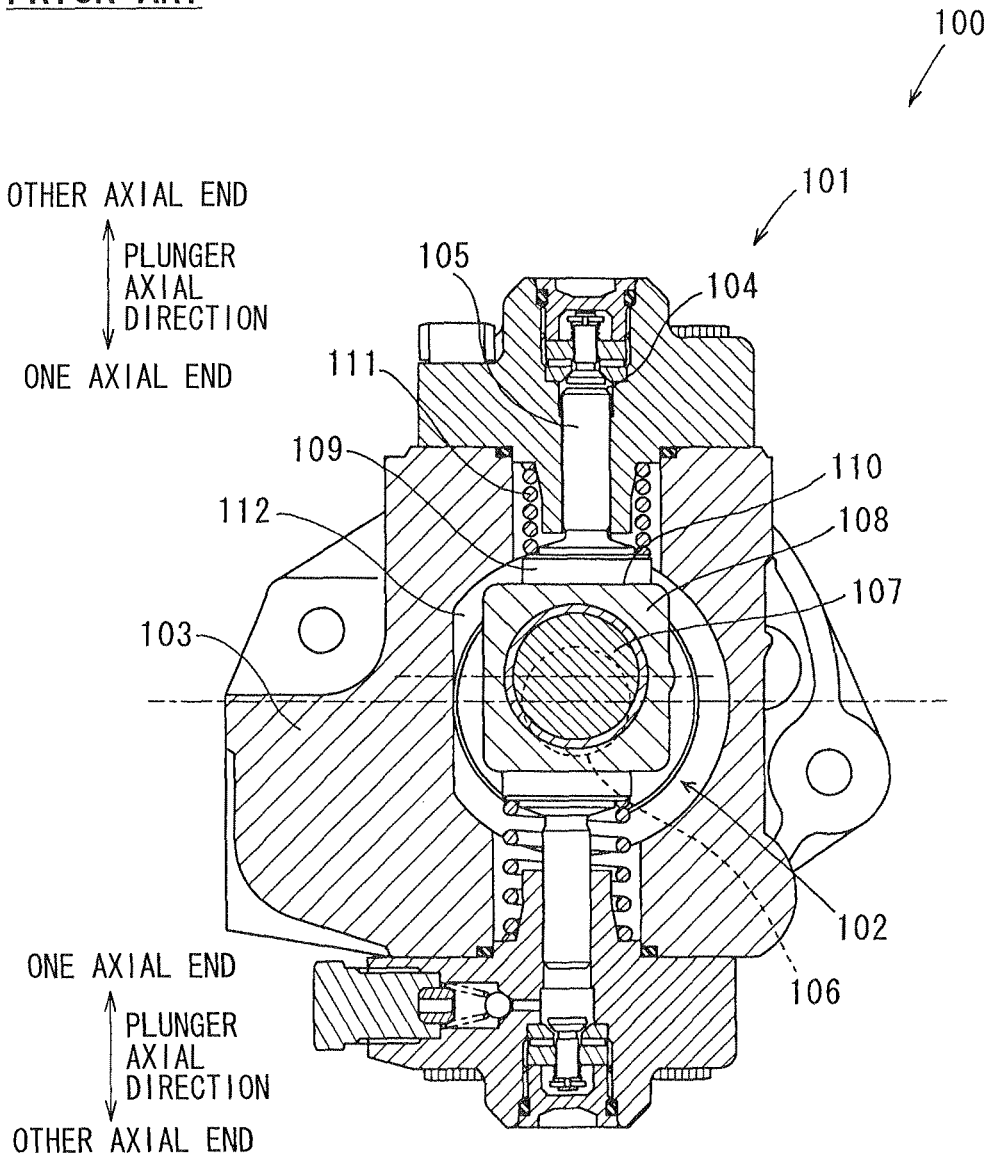
FIG. 6 PRIOR ART
FIG. 6 is a schematic cross sectional view, taken along a plane perpendicular to the shaft, showing a conventional fuel pump.

For example, according to the fuel pump 1 of the above embodiment, the first and second recessed portions 38*a* and 39*a* are formed on the first wall surface 37*a*, while the first and second recessed portions 38*b* and 39*b* are formed on the second wall surface 37*b*. As shown in FIG. 5, however, only the second recessed portion 39*a* may be formed on the first wall surface 37*a*, while only the second recessed portion 39*b* may be formed on the second wall surface 37*b*.

According to such a modification, the plunger head 19 could come in touch with the first and second wall surfaces 37*a* and 37*b* in the virtual situation, a possible adverse influence by such touch can be reduced by the second recessed portions 39*a* and 39*b*. Accordingly, the reliability of the fuel pump can be improved, wherein the virtual situation (in which the plunger head 19 would be separated from the plunger 13) is taken into consideration.

The second recessed portions 39*a* and 39*b* can be formed by a cutware, which can be inserted into the inside of the pump housing 10 (the housing body 27) through an opening of the pump housing, which is provided for attaching the cylinder head 14 to the pump housing 10. A process for forming the second recessed portions 39*a* and 39*b* is much easier than a process for forming the first and second recessed portions 38*a*, 38*b*, 39*a* and 39*b*.

According to the fuel pump 1 of the above embodiment, two high pressure pump portions 8 are arranged around the cam mechanism 9, wherein they are displaced by 180 degrees from each other. However, three or more than three high pressure pump portions 8 may be provided around the cam mechanism 9, and the countermeasure for improving the reliability may be applied to such a fuel pump as in the same manner to the above embodiment.

What is claimed is:

1. A fuel pump for an internal combustion engine comprising:

a high pressure pump portion for pressurizing fuel and pumping out pressurized fuel;

a cam mechanism driven by the engine and operating the high pressure pump portion; and a pump housing for accommodating the cam mechanism and supporting the high pressure pump portion;

wherein the high pressure pump portion has a pressurizing chamber and a plunger for expanding and reducing the pressurizing chamber, so that fuel is sucked into the pressurizing chamber and pumped out from the pressurizing chamber in accordance with the expansion and reduction of the pressurizing chamber;

wherein the cam mechanism has: a shaft driven to rotate by the engine; a cam member integrally and eccentrically formed with the shaft, so that the cam member moves around the shaft in accordance with the rotation of the shaft; and a cam ring movably supported by the cam member so as to move around the shaft without changing its posture;

wherein a plunger head is integrally formed with the plunger at one axial end thereof, which is an opposite side of the pressurizing chamber, and the plunger head has a larger diameter than the plunger;

wherein the cam ring has a contact surface, which is in a sliding contact with the plunger head;

wherein the plunger head is biased by a biasing member in a direction to the one axial end of the plunger so that the plunger head is in contact with the contact surface, and the plunger head moves on the contact surface to reciprocate relative to the contact surface and reciprocates in an axial direction of the plunger in accordance with the rotation of the cam ring;

wherein the pump housing has a cam chamber for accommodating the cam member, the cam ring and the plunger head;

wherein the cam chamber has a first wall surface and a second wall surface which are opposed to each other in a radial and horizontal direction of the shaft, and the cam chamber is so formed that the plunger head would not come in touch with the first wall surface and the second wall surface of the cam chamber even in a virtual situation;

wherein a center axis of the plunger is displaced from a center axis of the shaft in the horizontal direction to the first wall surface, so that the plunger head is displaced from a center of the contact surface in the horizontal direction toward the first wall surface when the plunger is at its top dead center;

wherein, in the virtual situation, it is supposed that the plunger head would be separated from the plunger, the plunger head would be in contact with the contact surface without a relative movement of the plunger head to the contact surface at a most remote position, and the cam member would be continuously rotated, wherein the most remote position corresponds to a relative position of the plunger head to the contact surface when the cam ring is moved to its closest position in the horizontal direction to the second wall surface during a normal operation of the plunger;

wherein a first recessed portion is formed on the first wall surface of the cam chamber and a second recessed portion is formed on the second wall surface of the cam chamber in order to avoid such a condition in which the plunger head would come in touch with the first and/or second wall surfaces in the virtual situation; and wherein a first distance between the center axis of the plunger and the first wall surface in the horizontal direction on a plane extending from the contact surface is larger than a second distance between the center axis of the plunger and the second wall surface in the horizontal direction on the plane extending from the contact surface, so that the first recessed portion formed on the first wall surface is larger than the second recessed portion formed on the second wall surface when compared on the horizontal plane extending from the contact surface.

2. The fuel pump according to the claim 1, wherein the biasing member is composed of a coil spring, which is coaxially arranged with the plunger and one axial end of which is supported by the plunger head; and the cam chamber is so formed that the coil spring would not come in touch with the first and/or the second wall surfaces of the cam chamber even in the virtual situation, wherein it is further supposed that the one axial end of the coil spring would be continuously supported by the plunger head.

3. The fuel pump according to the claim 2, wherein a third recessed portion is formed on the first wall surface of the cam chamber and a fourth recessed portion is formed on the second wall surface of the cam chamber in order to avoid such a condition in which the coil spring would come in touch with the first and/or second wall surfaces in the virtual situation; and a third distance between the center axis of the plunger and the first wall surface in the horizontal direction on a horizontal plane horizontally extending from a lower point of the coil spring is larger than a second distance between the center axis of the plunger and the second wall surface in the horizontal direction on the horizontal plane horizontal extending from the lower point of the coil spring, so that the third recessed portion formed on the first wall surface is made larger than the fourth recessed portion formed on the second wall surface, when compared on the horizontal plane extending in the horizontal direction in parallel to the contact surface.

4. A fuel pump for an internal combustion engine comprising:

a high pressure pump portion for pressurizing fuel and pumping out pressurized fuel;

a cam mechanism driven by the engine and operating the high pressure pump portion; and a pump housing for accommodating the cam mechanism and supporting the high pressure pump portion;

wherein the high pressure pump portion has a pressurizing chamber and a plunger for expanding and reducing the pressurizing chamber, so that fuel is sucked into the pressurizing chamber and pumped out from the pressurizing chamber in accordance with the expansion and reduction of the pressurizing chamber;

wherein the cam mechanism has: a shaft driven to rotate by the engine, a cam member integrally and eccentrically formed with the shaft so that the cam member moves around the shaft in accordance with the rotation of the shaft, and a cam ring movably supported by the cam member so as to move around the shaft without changing its posture;

wherein a plunger head is integrally formed with the plunger at one axial end thereof, which is an opposite side of the pressurizing chamber, and the plunger head has a larger diameter than the plunger;

wherein the cam ring has a contact surface, which is in a sliding contact with the plunger head;

wherein the plunger head is biased by a biasing member in a direction to the one axial end of the plunger so that the plunger head is in contact with the contact surface, and the plunger head moves on the contact surface to reciprocate relative to the contact surface and reciprocates in an axial direction of the plunger in accordance with the rotation of the cam ring;

wherein the pump housing has a cam chamber for accommodating the cam member, the cam ring and the plunger head;

wherein the biasing member is composed of a coil spring, which is coaxially arranged with the plunger and one axial end of which is supported by the plunger head;

wherein the cam chamber has a first wall surface and a second wall surface which are opposed to each other in a radial and horizontal direction of the shaft, wherein the cam chamber is so formed that the coil spring would not come in touch with the first wall surface and the second wall surface of the cam chamber even in a virtual situation, each of the first wall surface and the second wall surface being formed in an inner wall of the cam chamber at such a position surrounding the coil spring;

wherein a center axis of the plunger is displaced from a center axis of the shaft in the horizontal direction to the first wall surface, so that the plunger head is displaced from a center of the contact surface in the horizontal direction toward the first wall surface when the plunger is at its top dead center;

wherein, in the virtual situation, it is supposed that the plunger head would be separated from the plunger, the plunger head would be in contact with the contact surface without a relative movement of the plunger head to the contact surface at a most remote position, and the cam member would be continuously rotated, and it is further supposed that the one axial end of the coil spring would be continuously supported by the plunger head, wherein the most remote position corresponds to a relative position of the plunger head to the contact surface when the cam ring is moved to its closest position in the horizontal direction to the second wall surface during a normal operation of the plunger;

wherein a first recessed portion is formed on the first wall surface of the cam chamber and a second recessed portion is formed on the second wall surface of the cam chamber in order to avoid such a condition in which the coil spring would come in touch with the first and/or second wall surfaces in the virtual situation; and wherein a first distance between the center axis of the plunger and the first wall surface in the horizontal direction on a horizontal plane horizontally extending from a lower point of the coil spring is larger than a second distance between the center axis of the plunger and the second wall surface in the horizontal direction on the horizontal plane horizontally extending from the lower point of the coil spring, so that the first recessed portion formed on the first wall surface is larger than the second recessed portion formed on the second wall surface, when compared on the horizontal plane extending in the horizontal direction in parallel to the contact surface.

* * * * *